US009022736B2

(12) United States Patent
Lee et al.

(10) Patent No.: US 9,022,736 B2
(45) Date of Patent: May 5, 2015

(54) INTEGRATED AXIAL AND TANGENTIAL SERPENTINE COOLING CIRCUIT IN A TURBINE AIRFOIL

(75) Inventors: Ching-Pang Lee, Cincinnati, OH (US); Nan Jiang, Jupiter, FL (US); John J. Marra, Winter Springs, FL (US); Ronald J. Rudolph, Jensen Beach, FL (US); John P. Dalton, Wellington, FL (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 886 days.

(21) Appl. No.: 13/027,333

(22) Filed: Feb. 15, 2011

(65) Prior Publication Data

US 2012/0207614 A1 Aug. 16, 2012

(51) Int. Cl.
*F01D 5/18* (2006.01)

(52) U.S. Cl.
CPC ..... *F01D 5/188* (2013.01); *F01D 5/186* (2013.01); *F01D 5/187* (2013.01); *F05D 2250/185* (2013.01); *F05D 2260/2212* (2013.01)

(58) Field of Classification Search
CPC ..... F01D 5/186; F01D 5/187
USPC ..... 416/95, 96 R, 97 R
See application file for complete search history.

(56) References Cited

U.S. PATENT DOCUMENTS

| | | | | |
|---|---|---|---|---|
| 5,165,852 | A * | 11/1992 | Lee et al. | 416/97 R |
| 5,484,258 | A | 1/1996 | Isburgh et al. | |
| 5,486,090 | A | 1/1996 | Thompson et al. | |
| 5,660,524 | A | 8/1997 | Lee et al. | |
| 5,971,708 | A | 10/1999 | Lee | |
| 6,099,252 | A | 8/2000 | Manning et al. | |
| 6,273,682 | B1 | 8/2001 | Lee | |
| 6,984,103 | B2 | 1/2006 | Lee et al. | |
| 7,097,426 | B2 | 8/2006 | Lee et al. | |
| 7,131,818 | B2 | 11/2006 | Cunha et al. | |
| 7,249,934 | B2 * | 7/2007 | Palmer et al. | 416/97 R |
| 7,296,972 | B2 | 11/2007 | Liang | |
| 7,296,973 | B2 | 11/2007 | Lee et al. | |
| 7,347,671 | B2 | 3/2008 | Dorling et al. | |
| 7,481,622 | B1 * | 1/2009 | Liang | 416/97 R |
| 7,527,474 | B1 | 5/2009 | Liang | |
| 7,534,089 | B2 | 5/2009 | Liang | |
| 7,549,843 | B2 | 6/2009 | Liang | |

(Continued)

FOREIGN PATENT DOCUMENTS

| | | |
|---|---|---|
| EP | 2022941 A2 | 2/2009 |
| JP | 5175704 A | 8/1993 |

*Primary Examiner* — Ned Landrum
*Assistant Examiner* — Kayla McCaffrey

(57) ABSTRACT

A continuous serpentine cooling circuit forming a progression of radial passages (44, 45, 46, 47A, 48A) between pressure and suction side walls (52, 54) in a MID region of a turbine airfoil (24). The circuit progresses first axially, then tangentially, ending in a last radial passage (48A) adjacent to the suction side (54) and not adjacent to the pressure side (52). The passages of the axial progression (44, 45, 46) may be adjacent to both the pressure and suction side walls of the airfoil. The next to last radial passage (47A) may be adjacent to the pressure side wall and not adjacent to the suction side wall. The last two radial passages (47A, 48A) may be longer along the pressure and suction side walls respectively than they are in a width direction, providing increased direct cooling surface area on the interiors of these hot walls.

6 Claims, 5 Drawing Sheets

(56) References Cited

U.S. PATENT DOCUMENTS

| | | | | |
|---|---|---|---|---|
| 7,686,581 | B2 | 3/2010 | Brittingham et al. | |
| 7,695,245 | B1 | 4/2010 | Liang | |
| 7,699,583 | B2 | 4/2010 | Cunha | |
| 7,704,046 | B1 | 4/2010 | Liang | |
| 7,713,027 | B2 | 5/2010 | Cherolis et al. | |
| 7,717,675 | B1 | 5/2010 | Liang | |
| 2003/0026698 | A1 | 2/2003 | Flodman et al. | |
| 2004/0076519 | A1* | 4/2004 | Halfmann et al. | 416/97 R |
| 2006/0222495 | A1 | 10/2006 | Liang | |
| 2007/0104576 | A1 | 5/2007 | Cunha et al. | |
| 2008/0118366 | A1 | 5/2008 | Correia et al. | |
| 2009/0285683 | A1 | 11/2009 | Pietraszkiewicz et al. | |

* cited by examiner

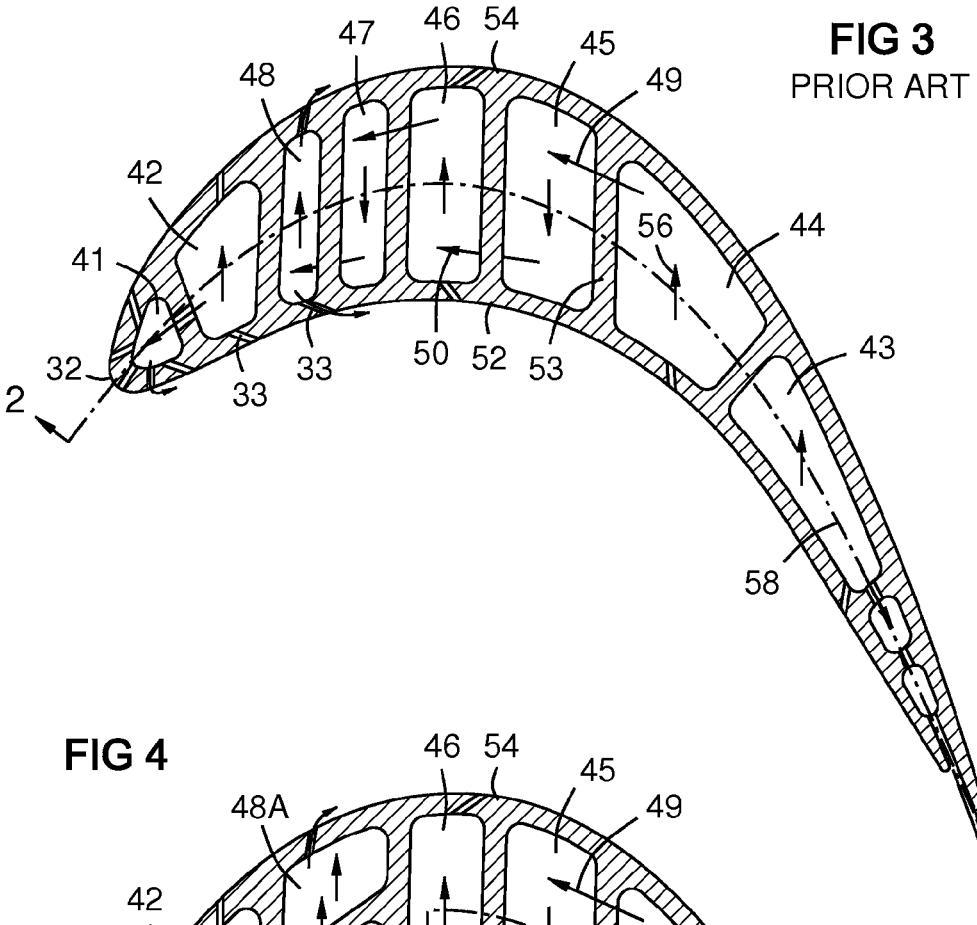
FIG 3
PRIOR ART
FIG 4
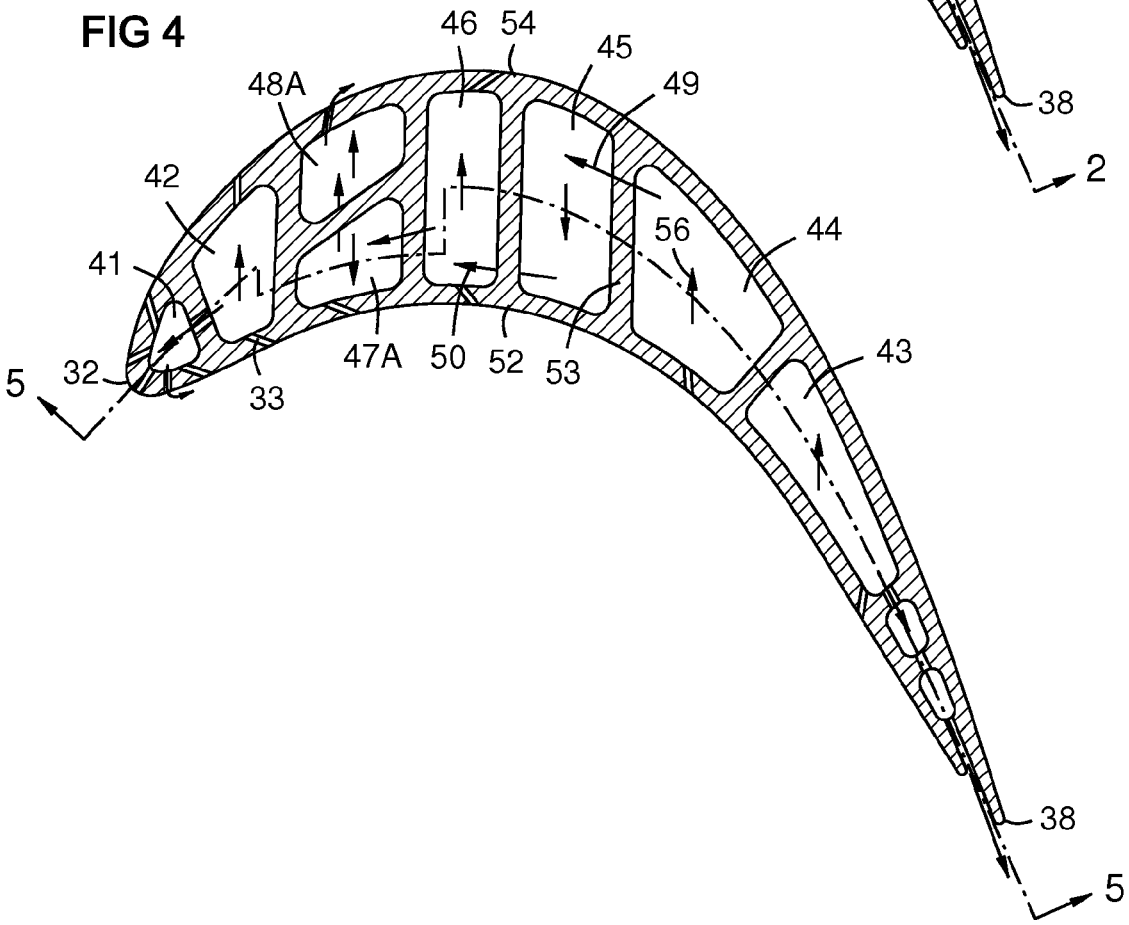

INTEGRATED AXIAL AND TANGENTIAL SERPENTINE COOLING CIRCUIT IN A TURBINE AIRFOIL

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates to cooling passages in turbine airfoils, and particularly to serpentine cooling circuits with multiple radially-oriented passes in alternating directions.

BACKGROUND OF THE INVENTION

Serpentine cooling passages inside a turbine blade are formed between external airfoil walls and internal partition walls. The external walls are in direct contact with hot combustion gases, and need sufficient cooling to maintain adequate material life. The interior surfaces of the external hot walls are the primary cooling surfaces. The internal partition walls are extensions from the hot walls, and have no direct contact with the hot gas, so they are much cooler. The surfaces of the internal partition walls serve as extended secondary cooling surfaces for the external hot walls by conduction. Cooling air flows through the serpentine cooling passages and picks up heat from the walls through forced convection. The effectiveness of this heat transfer rate is inversely proportional to the thermal boundary layer thickness. Turbulators are commonly cast on the interior surfaces of the hot external walls to promote flow turbulence and reduce the thickness of the thermal boundary layer for better convective heat transfer. High-temperature alloys generally have low thermal conductivity and therefore have low fin efficiency in heat transfer. To improve the internal cooling inside a turbine blade, it is important to have sufficient directly cooled primary surface with effective turbulators.

In a turbine blade, the airfoil typically has a larger thickness near the mid-chord region. In order to maintain sufficient speed of the cooling air inside cooling passages, the cooling passages near the maximum airfoil thickness location become very narrow, as shown in FIG. 3 passages 47 and 48. These narrow passages have small primary cooling surfaces on the hot walls, and large secondary cooling surfaces on the partition walls. The small primary cooling surfaces also limit the size of the turbulators and their effectiveness. These narrow passages cannot provide good convective cooling. The invention described herein significantly increases the primary cooling surfaces on the hot walls and provides sufficient surface area for effective turbulators.

BRIEF DESCRIPTION OF THE DRAWINGS

The invention is explained in the following description in view of the drawings that show:

FIG. 3 is a transverse sectional view taken along line 2-2 of FIG. 2.

FIG. 4 is a transverse sectional view of a turbine blade airfoil per the invention taken along line 4-4 of FIG. 5.

DETAILED DESCRIPTION OF THE INVENTION

Figure 1:
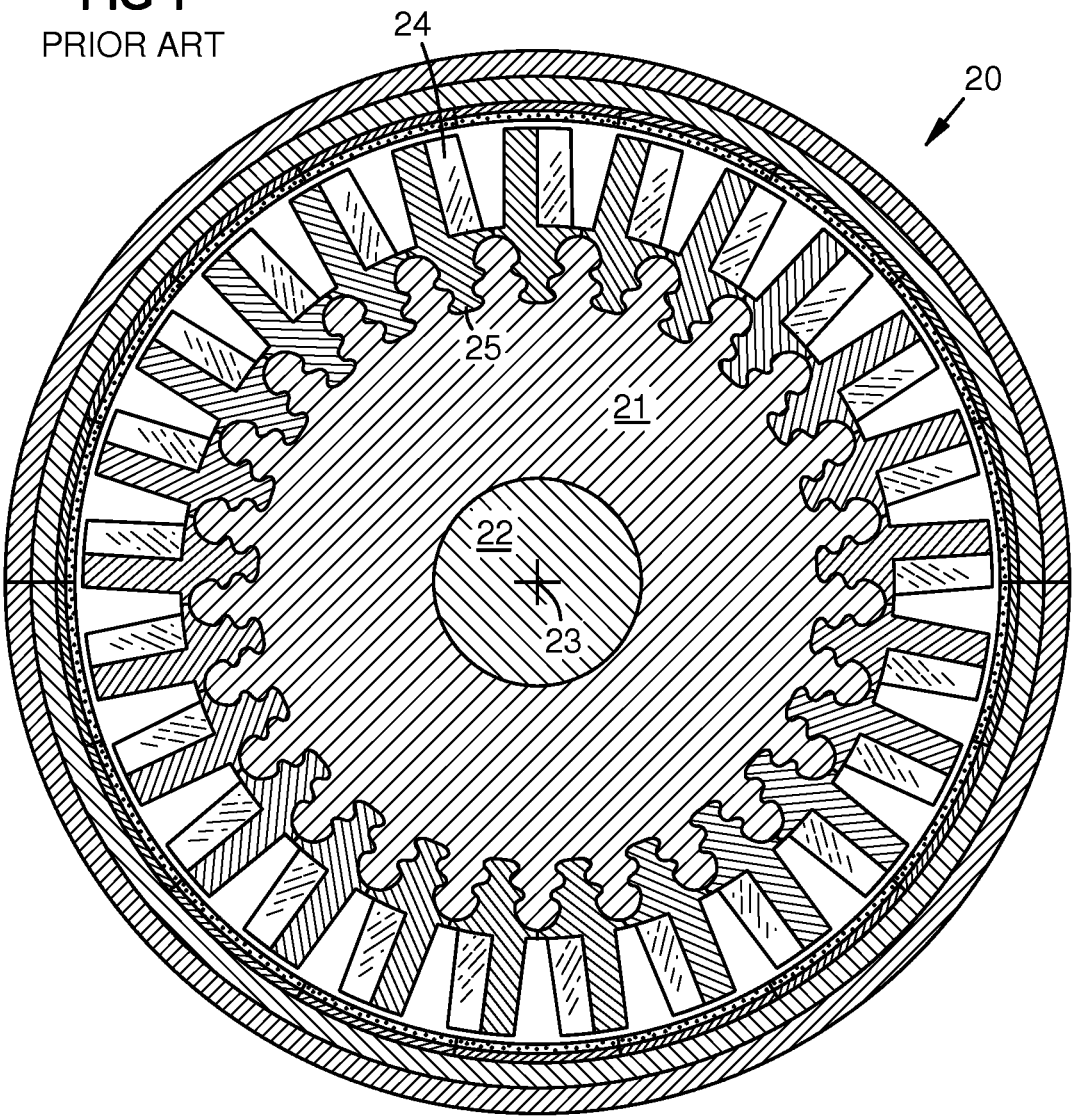
FIG 1 PRIOR ART
FIG. 1 is a conceptual sectional view of a prior art turbine rotor assembly.

FIG. 1 illustrates a rotor assembly 20 of a turbine, including a disc 21 on a shaft 22 with a rotation axis 23. Blade airfoils 24 are attached to the disc by mounting elements 25 such as dovetails, forming a circular array of airfoils around the circumference of the rotating disc.

Figure 2:
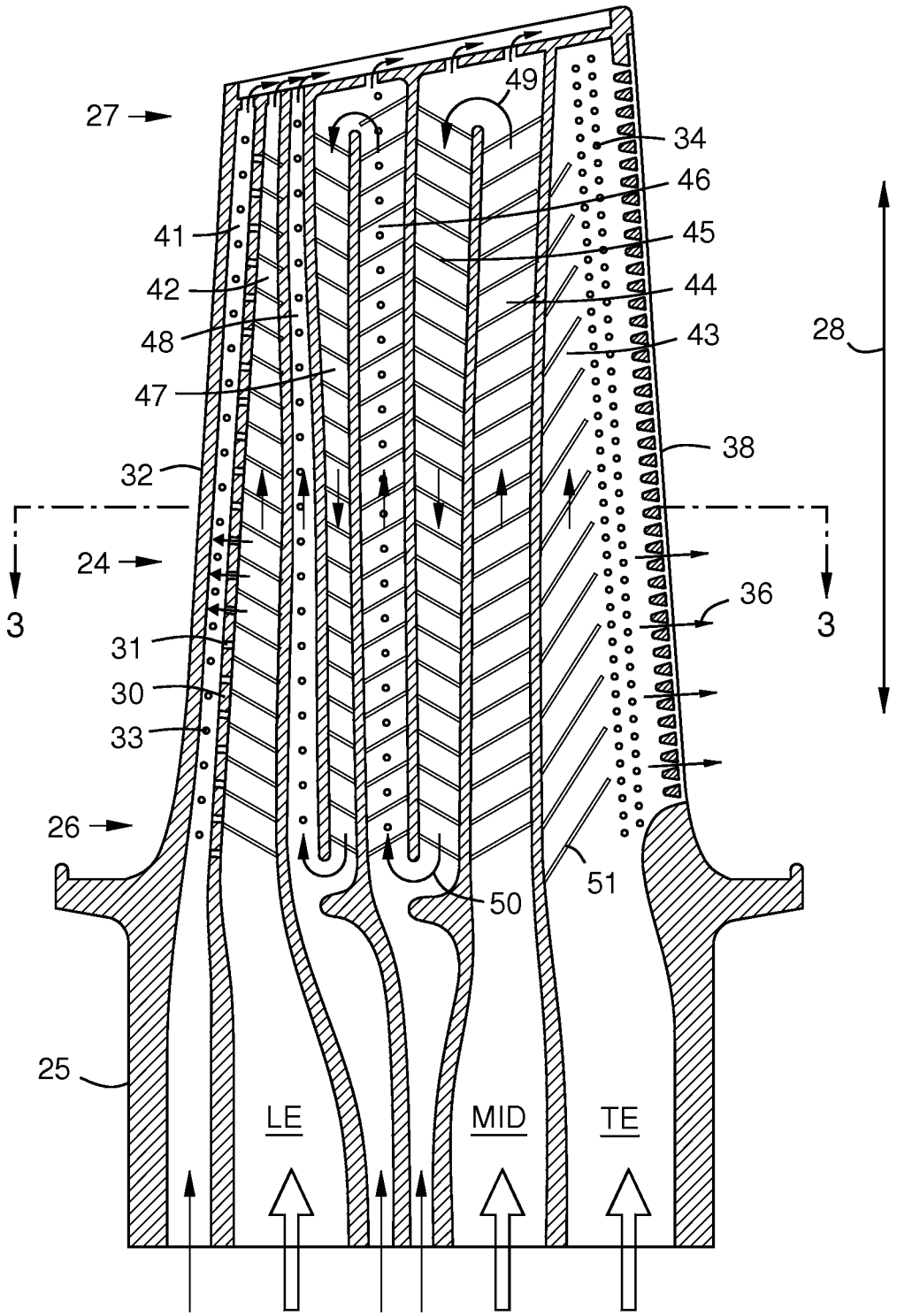
FIG 2 PRIOR ART
FIG. 2 is a side sectional view of a known turbine blade, sectioned along the mean camber line of FIG. 3.

FIG. 2 illustrates a known turbine blade airfoil 24 that spans between a root portion 26 and a tip portion 27 in a radial orientation 28 with respect to the rotation axis 23. A mounting element 25 is attached to the root portion 26, or is formed integrally therewith. Three internal cooling circuits are shown in the airfoil: 1) a leading edge circuit LE; 2) a trailing edge circuit TE; and 3) a middle circuit MID between the leading and trailing edge circuits. The leading edge circuit LE may have two radial passages 41, 42 with an impingement partition 30 between them with holes 31 that direct impingement jets against the leading edge 32. The coolant thus flows into the forward passage 41 from which it exits film cooling holes 33. The trailing edge circuit TE routes coolant through an aft radial passage 43, from which it passes between cooling and metering elements such as pins 34 and/or through small channels, then exits 36 the trailing edge 38. The middle circuit MID is a continuous serpentine circuit with an axial progression of radial passages 44, 45, 46, 47, 48 that route the coolant in alternating radial directions progressively forward in the airfoil. Herein "axial" means oriented generally along a mean camber line of the airfoil, which is a line or curve midway between the pressure and suction sides of the airfoil in a transverse section of the airfoil (see FIG. 3). The radial passages of circuit MID are interconnected 49, 50 at alternate ends to guide the coolant in alternating radial directions. The inner surfaces of the pressure and suction side walls within the radial passages may be lined with turbulators 51 such as angled ridges to increase cooling efficiency by disrupting the thermal boundary layer.

FIG. 3 is a transverse sectional view of an airfoil taken along line 3-3 of FIG. 2. Radial passages 41-48 are formed in a core portion of the airfoil between a pressure side wall 52 and a suction side wall 54 and partition walls 53. The MID circuit has radial passages 44-48 that progress axially, which means they form a sequence of passages that progress generally along the mean camber line 58. This is an axial serpentine cooling circuit.

Flow direction arrows 56 that are vertically oriented indicate whether the flow in a given radial passage is upward toward the blade tip or downward toward the blade root. A foreground arrow 50 that crosses a partition indicates flow between radial passages that occurs in the tip portion 27 of the airfoil. A background arrow 50 that crosses and is hidden by a partition indicates flow between radial passages that occurs in the root portion 26 of the airfoil. These arrows are provided to facilitate understanding of the exemplary drawings, but are not intended as limitations beyond the claim limitations.

Figure 5:
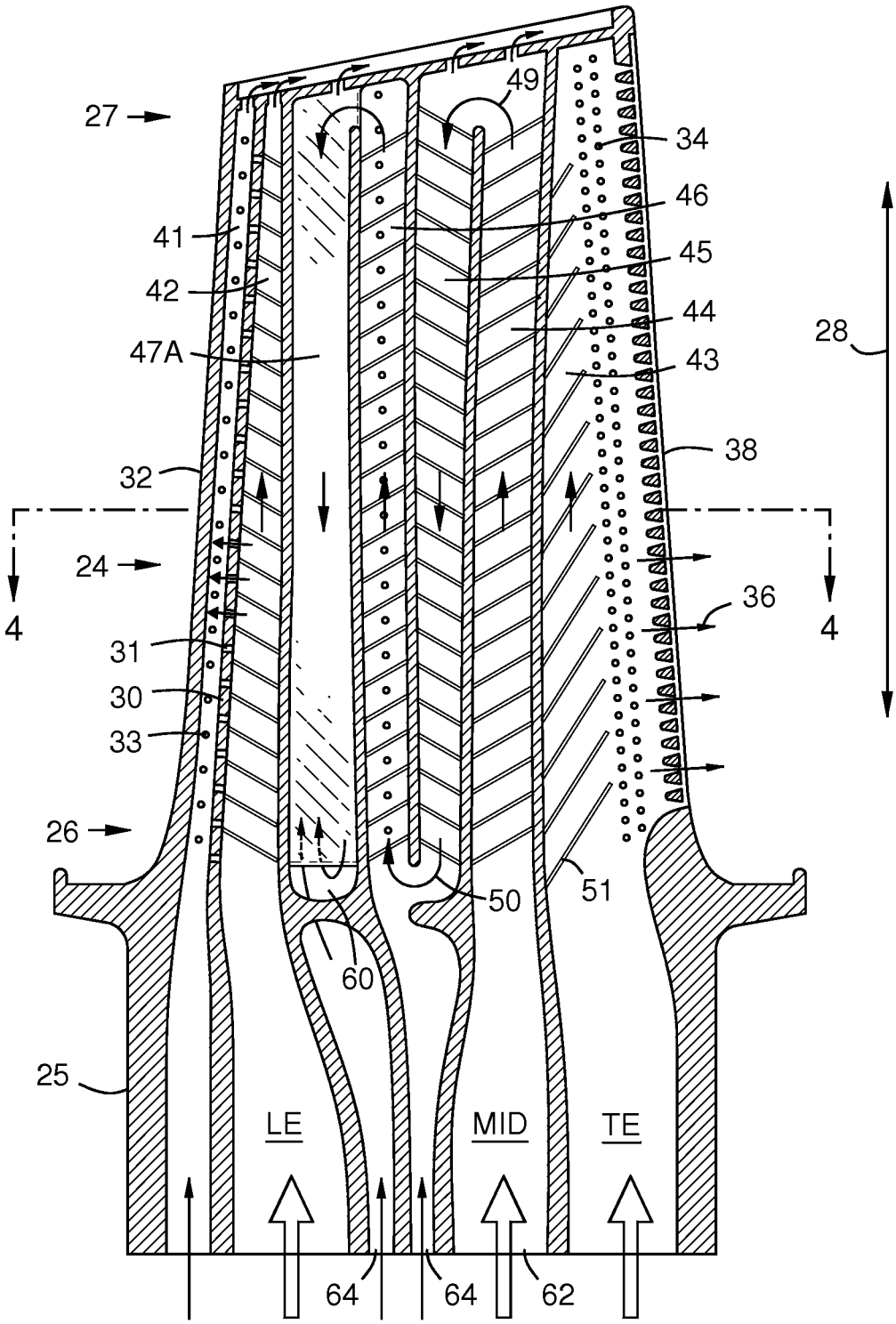
FIG. 5 is a side sectional view of a turbine blade taken along line 5-5 of FIG. 4.

FIG. 4 shows a transverse sectional view of an airfoil taken along line 4-4 of FIG. 5 according to aspects of the invention. Radial passages are disposed in a central or core portion of the airfoil between a pressure side wall 52 and a suction side wall 54. Radial passages 44, 45, and 46 form an axial progression.

Radial passages 47A and 48A form a tangential progression, meaning they progress in a direction transverse to the mean camber line. The section line 5-5 in FIG. 4 departs from the mean camber line to go through the next to last radial passage 47A.

The radial passage 47A may be considered to be part of both the axial and the tangential progressions. A simplified embodiment (not shown) of the MID circuit may have only three radial passages 46, 47A, and 48A, in which passages 46 and 47A define an axially progressing series of passages, and passages 47A and 48A define a tangentially progressing series. In such an embodiment, passage 46 has the primary coolant inlet through the mounting element 25.

FIG. 5 is a transverse sectional view of an airfoil taken along line 5-5 of FIG. 4, looking toward the interior surface of the suction side wall 54. Radial passages 44-46 form an axially progressing sequence. Radial passage 47A is interconnected to radial passage 48A (not visible in this view) via a pass-through 60 in the root portion 26 of the airfoil 24. Passage 44 is a feed passage with a primary inlet 62 in the mounting element 25. Secondary inlets 64 may provide lesser flows that refresh the coolant in at intermediate points in the circuit 44, 45, 46, 47A, 47B, as some of the coolant in the circuit is lost to film cooling.

Figure 6:
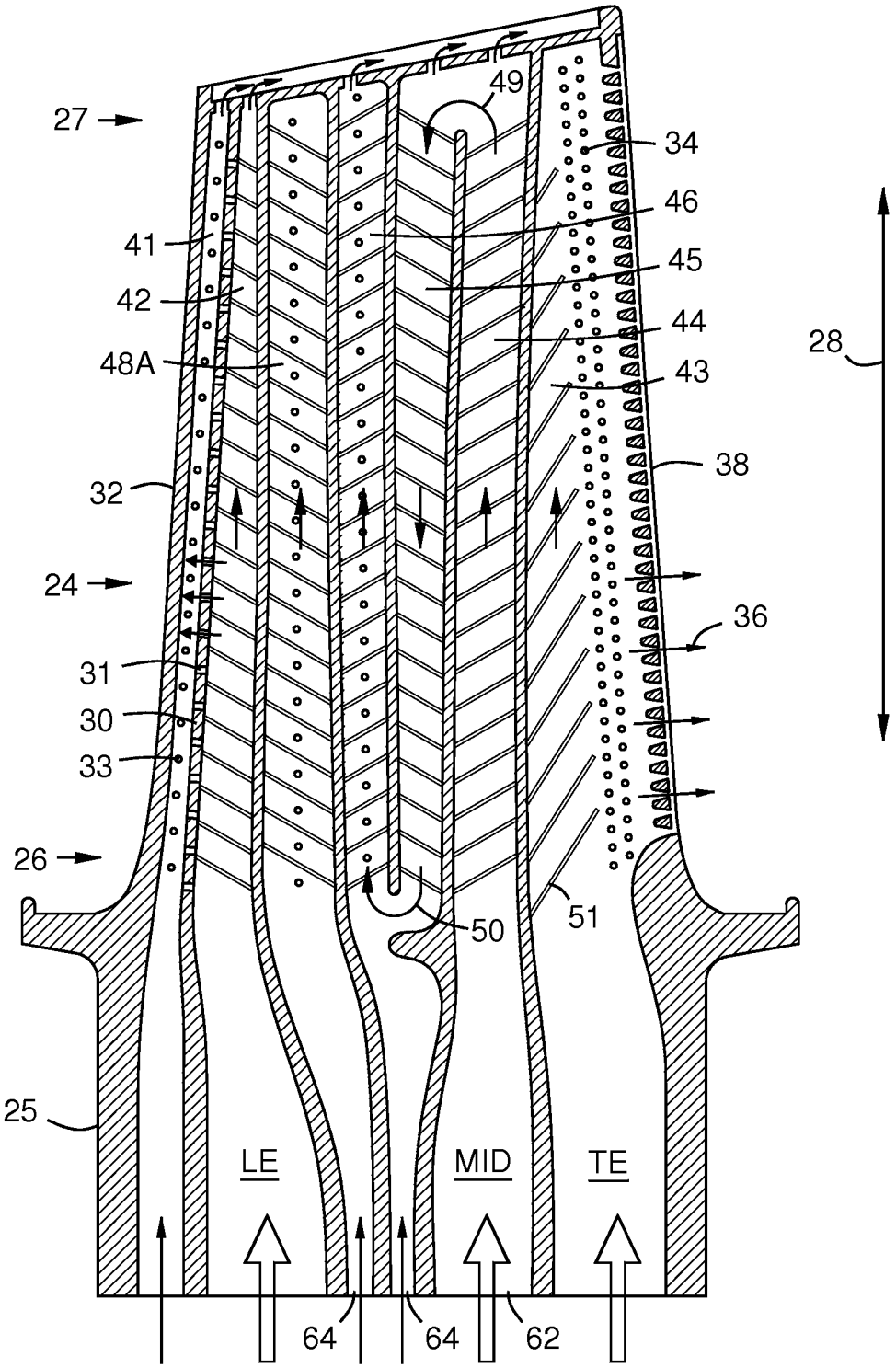
FIG. 6 is a view as in FIG. 5 except the sectioning line goes through the last radial passage of the MID cooling circuit to show the inner surface of the suction side wall.

FIG. 6 is a view as in FIG. 5 except the sectioning goes through the last radial passage 48A of the MID cooling circuit, to show the interior surface of the suction side wall 54.

A continuous serpentine cooling circuit per the invention forms a progression of radial passages between a pressure side wall 52 and a suction wall 54 of the airfoil. The radial passages are interconnected at alternate ends to guide a coolant flow in alternating radial directions. The circuit first progresses axially via an axial progression of the passages, then it progresses tangentially with the last two of the radial passages 47A, 48A. The radial passages 44, 45, 46 of the axial progression may be adjacent to both the pressure side wall 52 and the suction side wall 54 of the airfoil 26. The last radial passage 48A may be adjacent to the suction side wall 54 and not adjacent to the pressure side wall 52. The next to last radial passage 47A may be adjacent to the pressure side wall 52, and not adjacent to the suction side wall 54. Cross sectional areas of the last two radial passages 47A, 48A may be longer along the pressure and suction side walls respectively than the prior art. Cross-sectional aspect ratios may be defined for passages 47A, 48A as being the length of the cross sectional area of each passage along the pressure or suction side wall respectively, or along the mean camber line, divided by the width of the cross-sectional area in the transverse direction. The last two cooling channels 47A, 48A may each have a cross-sectional aspect ratio greater than 0.6 or greater than 1.0 or greater than 1.2 in some embodiments, although these ratios are not required in all embodiments. The term "elongated" herein means longer in one dimension than in a transverse dimension.

Benefits of the invention include:

Significantly larger interior direct cooling surface area on the hot walls 52, 54 in passages 47A and 48A as compared to prior passages 47 and 48 of FIG. 3. Passages 47A and 48A may be elongated along the hot walls instead of being elongated along the partition walls 53.

Cooler cooling air for cooling the pressure side wall 52 in passage 47A than in the prior passage 47, because now the air passes over the pressure side wall 52 before passing over the suction side wall 54. This is beneficial because the pressure side wall is in general hotter than the suction side wall.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine airfoil with a radial span, comprising:

a continuous serpentine cooling circuit comprising a first series of radial passages and a second series of radial passages, wherein all of the radial passages guide a coolant to flow in alternating radial directions in a flow order, the first series progressing axially, and the second series progressing tangentially;

wherein the serpentine cooling circuit comprises:

a first radial passage with a primary coolant inlet in a root portion of the airfoil;

a second radial passage parallel with and adjacent to the first radial passage and connected thereto in a tip portion of the airfoil;

a third radial passage parallel with and adjacent to the second passage and connected thereto in the root portion of the airfoil;

a fourth radial passage parallel with and adjacent to the third radial passage and connected thereto in the tip portion of the airfoil; and a fifth radial passage parallel with and adjacent to the fourth radial passage and connected thereto in the root portion of the airfoil;

wherein each of the first, second, and third radial passages are adjacent to both a pressure side and a suction side of the airfoil;

wherein the fourth radial passage is adjacent to the pressure side of the airfoil and is not adjacent to the suction side of the airfoil; and wherein the fifth radial passage is adjacent to the suction side of the airfoil, and is not adjacent to the pressure side of the airfoil.

2. The turbine airfoil of claim 1, wherein the fifth radial passage and the fourth radial passage each have cross sectional areas that are elongated along the suction side and the pressure side of the airfoil respectively.

3. The turbine airfoil of claim 1, wherein the fifth radial passage and the fourth radial passage each have cross sectional areas that are elongated in a direction of a mean camber line of the airfoil with an aspect ratio greater than 0.6.

4. The turbine airfoil of claim 1, wherein the fourth radial passage has film cooling holes that exit the pressure side of the airfoil, and the fifth radial passage has film cooling holes that exit the suction side of the airfoil.

5. The turbine airfoil of claim 1, wherein the first radial passage is closer to a trailing edge of the airfoil than is the fifth radial passage.

6. The turbine airfoil of claim 5, wherein the serpentine cooling circuit is a middle circuit disposed between at least a leading edge cooling circuit and a trailing edge cooling circuit in the airfoil.

* * * * *